US006997144B2

(12) United States Patent
Sugano et al.

(10) Patent No.: US 6,997,144 B2
(45) Date of Patent: Feb. 14, 2006

(54) CYLINDER HEAD STRUCTURE FOR AN INTERNAL COMBUSTION ENGINE

(75) Inventors: Tomohiro Sugano, Kanagawa (JP); Keiji Shimotani, Kanagawa (JP); Hideki Kubo, Kanagawa (JP); Yumiko Umemura, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 77 days.

(21) Appl. No.: 10/820,064

(22) Filed: Apr. 8, 2004

(65) Prior Publication Data

US 2004/0200444 A1 Oct. 14, 2004

(30) Foreign Application Priority Data

Apr. 10, 2003 (JP) ..... 2003-106279

(51) Int. Cl.
*F02F 1/36* (2006.01)

(52) U.S. Cl. ..... 123/41.82 R; 123/193.5

(58) Field of Classification Search ..... 123/41.82 R, 123/193.5

See application file for complete search history.

(56) References Cited

U.S. PATENT DOCUMENTS 5,964,196 A * 10/1999 Sigle et al. ..... 123/193.5
6,253,729 B1 * 7/2001 Suzuki et al. ..... 123/295

* cited by examiner

*Primary Examiner*—Noah P. Kamen
(74) *Attorney, Agent, or Firm*—James N. Dresser, Esq.

(57) ABSTRACT

A cylinder head structure for an internal combustion engine that is disposed on the upper surface of a cylinder body in which a plurality of cylinders are arranged in the lengthwise direction thereof, and that has an exhaust port, an intake port and a fuel injector mounting hole for each of the cylinders; a boss for bolt hole having a bolt hole for inserting a cylinder head bolt on the exhaust port side and a boss for bolt hole having a bolt hole for inserting a cylinder head bolt on the intake port side being provided between the exhaust ports and between the intake ports of the neighboring cylinders, and a partitioning wall being formed for coupling the boss for bolt hole on the exhaust port side to the boss for bolt hole on the intake port side and for sectionalizing the cooling water chamber, wherein the boss for bolt hole on the intake port side is provided with guide portions that guide the cooling water flowing into the cooling water chamber to the side of the fuel injector mounting hole from the exhaust port side.

2 Claims, 2 Drawing Sheets

CYLINDER HEAD STRUCTURE FOR AN INTERNAL COMBUSTION ENGINE

FIELD OF THE INVENTION

The present invention relates to a cylinder head structure for a direct cylinder fuel injection internal combustion engine, and more specifically to a cylinder head structure for an internal combustion engine capable of effectively cooling fuel injectors disposed in the fuel injector mounting holes formed in a cylinder head.

DESCRIPTION OF THE RELATED ART

A cylinder head for a direct cylinder fuel injection internal combustion engine is provided with exhaust ports and intake ports for each of a plurality of cylinders arranged in the lengthwise direction of a cylinder body, and with fuel injector mounting holes. A fuel injector disposed in each fuel injector mounting hole is heated by the cylinder and by the heat of combustion in a combustion chamber formed under the lower surface of the cylinder head. As the temperature at the end of the fuel injector nozzle rises, the fuel is transformed upon undergoing thermal action and adheres as a deposit. This adhesion of deposit exerts an influence on the emission and the like owing to changes in the flow rate of the fuel and in the angle of injection. However, it has already been confirmed that such effect upon the emission can be prevented by lowering the temperature of the fuel injectors.

In order to cool the fuel injectors, Japanese Unexamined Patent Publication JP-A 10-288081 discloses a cylinder head structure in which a fuel injector mounting hole is formed on the underside of the intake port, and a cooling water jacket is provided on the underside of the fuel injector mounting hole.

In the cylinder head structure disclosed in the above publication, however, the structure of the cooling water jacket surrounding the fuel injector mounting hole tends to form a closed space, and the cooling efficiency is not necessarily satisfactory. Besides, the cooling pump of a large capacity must be employed if it is attempted to cool the closed space intensively.

SUMMARY OF THE INVENTION

It is therefore an object of the present invention to provide a cylinder head structure for an internal combustion engine capable of efficiently cooling the fuel injectors mounted on a cylinder head.

In order to achieve the above object according to the present invention, there is provided a cylinder head structure for an internal combustion engine that is disposed on the upper surface of a cylinder body in which a plurality of cylinders are arranged in the lengthwise direction thereof and that has an exhaust port, an intake port and a fuel injector mounting hole for each of the cylinders, wherein the exhaust port is opened, at its one end, in a combustion chamber formed under the lower surface of the cylinder head and is opened, at its other end, on the side of one side surface of the cylinder head in parallel with the lengthwise direction thereof, the intake port is opened, at its one end, in said combustion chamber and is opened, at its other end, on the side of the other side surface of the cylinder head in parallel with the lengthwise direction thereof, the fuel injector mounting hole is provided on the lower side of the intake port nearly in parallel with the intake port, is opened, at its one end, in the combustion chamber and is opened, at its other end, on the side of the other side surface of the cylinder head in parallel with the lengthwise direction thereof, a boss for bolt hole on the exhaust port side and a boss for bolt hole on the intake port side, each having a bolt hole for inserting a cylinder head bolt, are provided between the exhaust ports and between the intake ports of the neighboring cylinders, a partitioning wall is formed for coupling the boss for bolt hole on the exhaust port side to the boss for bolt hole on the intake port side, and for sectionalizing the cooling water chamber for each of the cylinders, and a cooling water jacket is formed along the other side surface in which the fuel injector mounting holes are formed, and is communicated with the cooling water chambers; characterized in that the boss for bolt hole on the intake port side is provided with guide portions that guide the cooling water flowing into the cooling water chamber to the side of the fuel injector mounting hole from the exhaust port side.

It is desired that the cooling water jacket is so formed as to pass on the underside of the fuel injector mounting holes.

DETAILED DESCRIPTION OF THE PREFERRED EMBODIMENT

The invention will be described in further detail with reference to the accompanying drawings illustrating a preferred embodiment of a cylinder head structure for an internal combustion engine constituted according to the invention.

Figure 1:
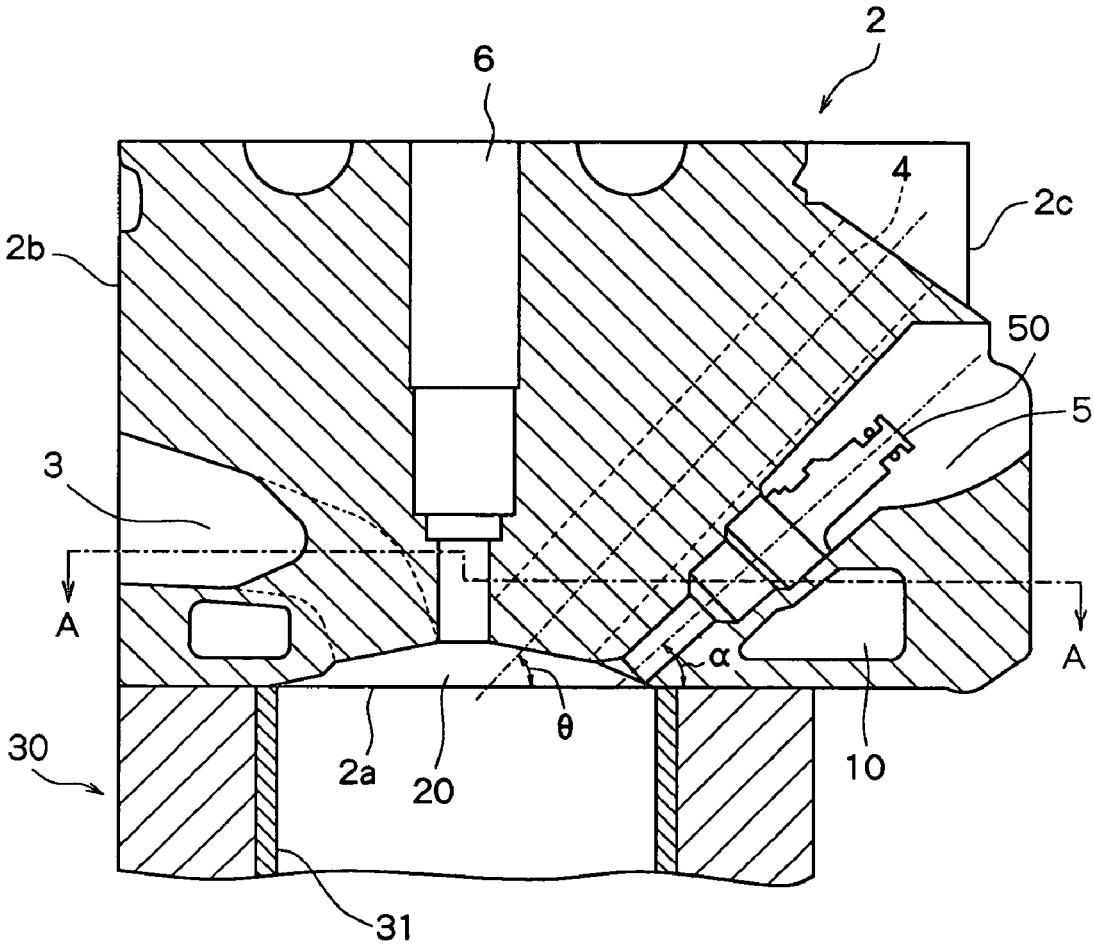
FIG. 1 is a sectional view of a cylinder head for an internal combustion engine constituted according to the present invention.
Figure 2:
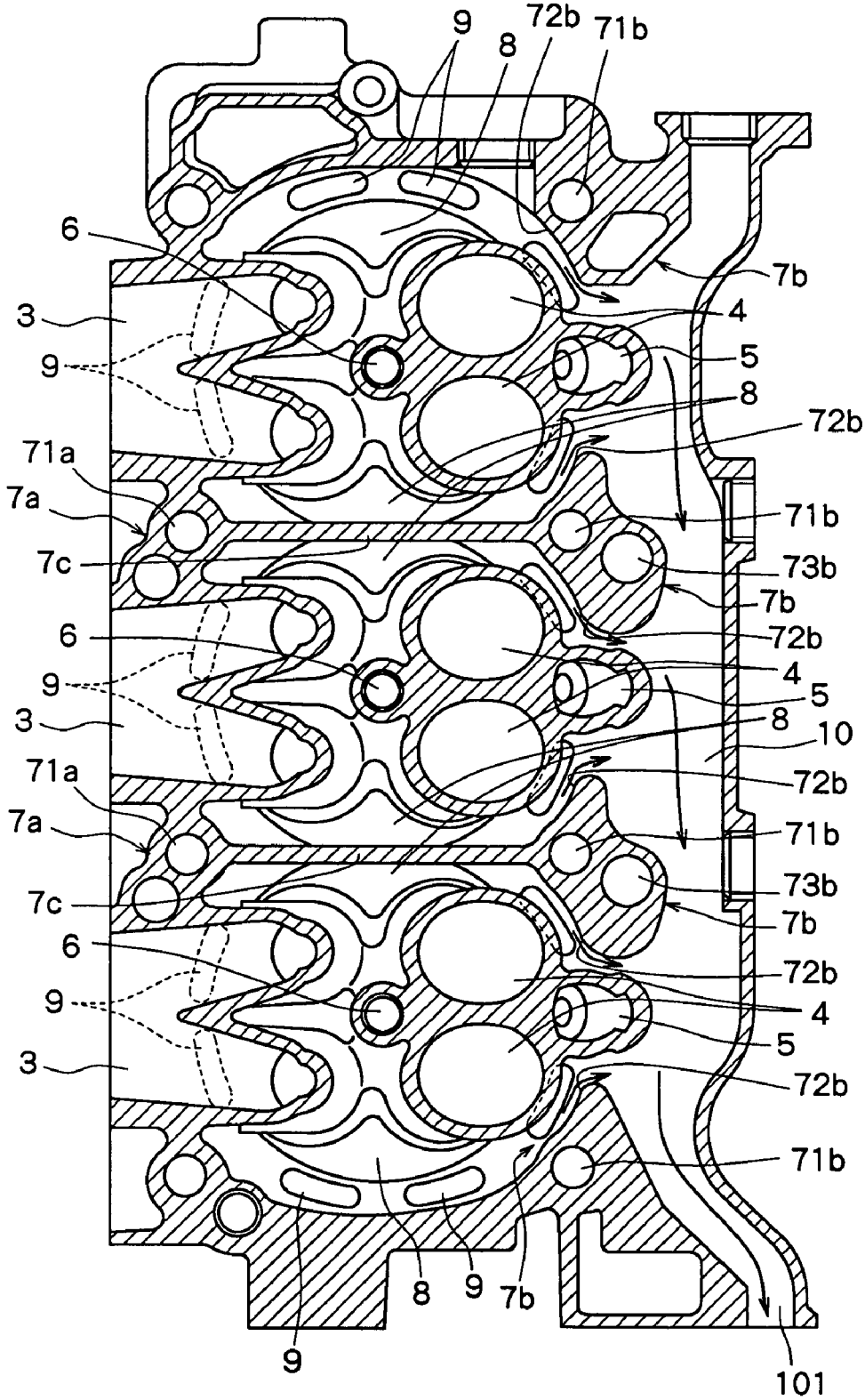
FIG. 2 is a sectional view along the line A—A in FIG. 1.

FIG. 1 is a sectional view of a cylinder head for an internal combustion engine constituted according to the present invention, and FIG. 2 is a sectional view along the line A—A in FIG. 1. A cylinder head 2 of the illustrated embodiment is disposed on the upper surface of a cylinder body 30. The cylinder body 30 has a plurality of cylinders 31 (three cylinders in the illustrated embodiment) arranged in the lengthwise direction (in a direction perpendicular to the surface of the paper in FIG. 1).

The cylinder head 2 disposed on the upper surface of the cylinder body 30 has an exhaust port 3, an intake port 4 and a fuel injector mounting hole 5 provided for each of the cylinders 31 in a direction at right angles with the lengthwise direction (at right angles with the direction which is perpendicular to the surface of the paper in FIG. 1, or at right angles with the up-and-down direction in FIG. 2). The exhaust port 3 is opened, at its one end, in a combustion chamber 20 formed in the lower surface 2*a* of the cylinder head 2 and is opened, at its other end, on the side of one side surface 2*b* of the cylinder head 2 in parallel with the lengthwise direction thereof. The intake port 4 is opened, at its one end, in the combustion chamber 20 and is opened, at its other end, on the side of the other side surface 2*c* of the cylinder head 2 in parallel with the lengthwise direction thereof. In the illustrated embodiment, the intake port 4 is formed at an angle (θ) of about 47 degrees relative to the lower surface 2*a* of the cylinder head 2. The fuel injector mounting hole 5 is provided on the lower side of the intake port 4 nearly in parallel with the intake port 4, is opened, at its one end, in the combustion chamber 20 and is opened, at its other end, in the other side surface 2*c* of the cylinder head 2. In the illustrated embodiment, the fuel injector mounting hole 5 is formed at an angle (α) of about 42 degrees relative to the lower surface 2*a* of the cylinder head 2. A fuel injector 50 is mounted in the thus formed fuel injector mounting hole 5. The cylinder head 2 is further provided with a spark plug mounting hole 6 between the exhaust port 3 and the intake port 4.

The cylinder head 2 is provided with a boss 7*a* for bolt hole having a bolt hole 71*a* on the exhaust port side and a boss 7*b* for bolt hole having a bolt hole 71*b* on the intake port side for inserting cylinder head bolts (not shown) respectively between the exhaust ports 3 and between the intake ports 4 of the neighboring cylinders. Further, the boss 7*a* for bolt hole having the bolt hole 71*a* on the exhaust port side is provided between the exhaust ports 3 at both ends and the boss 7*b* for bolt hole having the bolt hole 71*b* on the intake port side is provided also between the intake ports 4 at both ends. The cylinder head 2 is provided with partitioning walls 7*c* for coupling the bosses 7*a* for bolt holes on the exhaust port side to the bosses 7*b* for bolt holes on the intake port side, and for sectionalizing the cooling water chamber 8 for each of the cylinders. The partitioning walls 7*c* are formed from the upper surface of the cylinder head 2 up to the lower surface thereof, and contribute to increasing the rigidity around the exhaust ports 3 and the intake ports 4. The cylinder head 2 has a plurality of cooling water passages 9 formed therein, that are communicated with the cooling water passages (not shown) formed in the cylinder body 30 and are opened to the cooling water chambers 8. In the illustrated embodiment, the bosses 7*b* for bolt holes on the intake port side are provided with guide portions 72*b*, 72*b* that guide the cooling water flowing into the cooling water chambers 8 to the side of the intake ports 4 and the fuel injector mounting holes 5. In the illustrated embodiment, a blowby gas passage 73*b* is formed in the bosses 7*b* for bolt holes on the intake port side.

The cylinder head 2 further has a cooling water jacket 10 that is formed along the other side surface 2*c* and is communicated with the cooling water chambers 8. As illustrated in FIG. 1, the cooling water jacket 10 is so provided as to pass on the underside of the fuel injector mounting holes 5.

The cylinder head structure for an internal combustion engine according to the illustrated embodiment is constituted as described above. The cooling water flowed into the cooling chambers 8 from the cooling water passages (not shown) formed in the cylinder body 10 through the cooling water passages 9 cools the surroundings of the exhaust ports 3 that must be efficiently cooled, cools the side portions of the intake ports 4, turns to the right ends in FIG. 2 of the intake ports 4 while being guided by the guide portions 72*b* provided for the bosses 7*b* for bolt holes on the intake port side to cool the right end portions, meets around the fuel injector mounting holes 5, and efficiently cools the surroundings of the fuel injector mounting holes 5. Then, the cooling water flows down through the cooling water jacket 10 as indicated by an arrow in FIG. 2, and is sucked by a water pump through a duct (not shown) from a cooling water outlet 101 formed at the lower end in FIG. 2. Since the cooling water jacket 10 is formed on the underside of the fuel injector mounting holes 5, the side walls of the cylinders can be formed straightly permitting the cooling water to smoothly flow without stagnating, and the downstream side does not have a disadvantage in aspect of cooling efficiency.

Since the cylinder head structure for an internal combustion engine according to the illustrated embodiment is constituted as described above, the cooling water flows into the cooling chambers from the cylinder body through the cooling water passages, cools the surroundings of the exhaust ports that must be efficiently cooled and of the intake ports, guided by the guide portions provided for the bosses for bolt holes on the intake port side and meets around the fuel injector mounting holes, and efficiently cools the surroundings of the fuel injector mounting holes evenly for each of the cylinders.

We claim:

1. A cylinder head structure for an internal combustion engine that is disposed on the upper surface of a cylinder body in which a plurality of cylinders are arranged in the lengthwise direction thereof, and that has an exhaust port, an intake port and a fuel injector mounting hole for each of the cylinders, wherein said exhaust port is opened, at its one end, in a combustion chamber formed under the lower surface of said cylinder head and is opened, at its other end, on the side of one side surface of said cylinder head in parallel with the lengthwise direction thereof, said intake port is opened, at its one end, in said combustion chamber and is opened, at its other end, on the side of the other side surface of said cylinder head in parallel with the lengthwise direction thereof, said fuel injector mounting hole is provided on the lower side of said intake port nearly in parallel with said intake port, is opened, at its one end, in said combustion chamber and is opened, at its other end, on the side of the other side surface of said cylinder head in parallel with the lengthwise direction thereof, a boss for bolt hole on the exhaust port side and a boss for bolt hole on the intake port side, each having a bolt hole for inserting a cylinder head bolt, are provided between the exhaust ports and between the intake ports of the neighboring cylinders, a partitioning wall is formed for coupling said boss for bolt hole on the exhaust port side to said boss for bolt hole on the intake port side, and for sectionalizing a cooling water chamber for each of the cylinders, and a cooling water jacket is formed along the other side surface in which said fuel injector mounting holes are formed, and is communicated with said cooling water chambers;

characterized in that said boss for bolt hole on the intake port side is provided with guide portions that guide the cooling water flowing into the cooling water chamber to the side of the fuel injector mounting hole from the exhaust port side.

2. A cylinder head structure for an internal combustion engine according to claim 1, wherein said cooling water jacket is so provided as to pass on the underside of the fuel injector mounting holes.

* * * * *